United States Patent [19]

Smolderen

[11] 4,103,775

[45] Aug. 1, 1978

[54] FOUR-CORNERED FLAT WRAPPING

[75] Inventor: Albert Emiel Smolderen, Aartselaar, Belgium

[73] Assignee: AGFA-GEVAERT N.V., Mortsel, Belgium

[21] Appl. No.: 402,164

[22] Filed: Oct. 1, 1973

Related U.S. Application Data

[62] Division of Ser. No. 174,807, Aug. 25, 1971, Pat. No. 3,782,067.

[30] Foreign Application Priority Data

Aug. 26, 1970 [GB] United Kingdom ..... 41126/70

[51] Int. Cl.[2] ..... B65B 9/02

[52] U.S. Cl. ..... 206/455; 229/87 R; 428/192

[58] Field of Search ..... 53/28, 32, 180, 209; 156/202, 204, 216; 161/102, 99, 102, 104; 206/454, 455, 456; 428/121, 124, 126–130, 192

[56] References Cited

U.S. PATENT DOCUMENTS

| | | | |
|---|---|---|---|
| 1,394,503 | 10/1921 | Taylor | 229/51 AS |
| 1,650,051 | 11/1927 | Smith | 242/222 |
| 2,384,494 | 9/1945 | Schutter | 53/28 |
| 2,858,582 | 11/1958 | Toulmin, Jr. | 161/118 X |
| 3,411,263 | 11/1968 | Smolderen | 53/28 |
| 3,741,386 | 6/1973 | Schmidt | 206/455 |

FOREIGN PATENT DOCUMENTS

| | | | |
|---|---|---|---|
| 1,053,512 | 1/1967 | United Kingdom | 206/455 |
| 1,141,805 | 2/1969 | United Kingdom | 206/455 |

*Primary Examiner*—George F. Lesmes
*Assistant Examiner*—Henry F. Epstein
*Attorney, Agent, or Firm*—William J. Daniel

[57] ABSTRACT

A flat wrapping or package, e.g., for film sheets, particularly sheets of X-ray film, in which the margins of one web of wrapping material are folded inwardly over the edge margins of a narrower web of wrapping paper with the film sheets sandwiched in between, the contacting web portions are adhered together, and cut edges are sealed together. Each exterior web fold edge is creased along two closely spaced parallel lines spaced apart approximately the thickness of the wrapped film sheet so as to impart to the opposite side edges of the wrapping a generally concave configuration between an upper and lower corner.

2 Claims, 7 Drawing Figures

Figures 1, 6, 7:
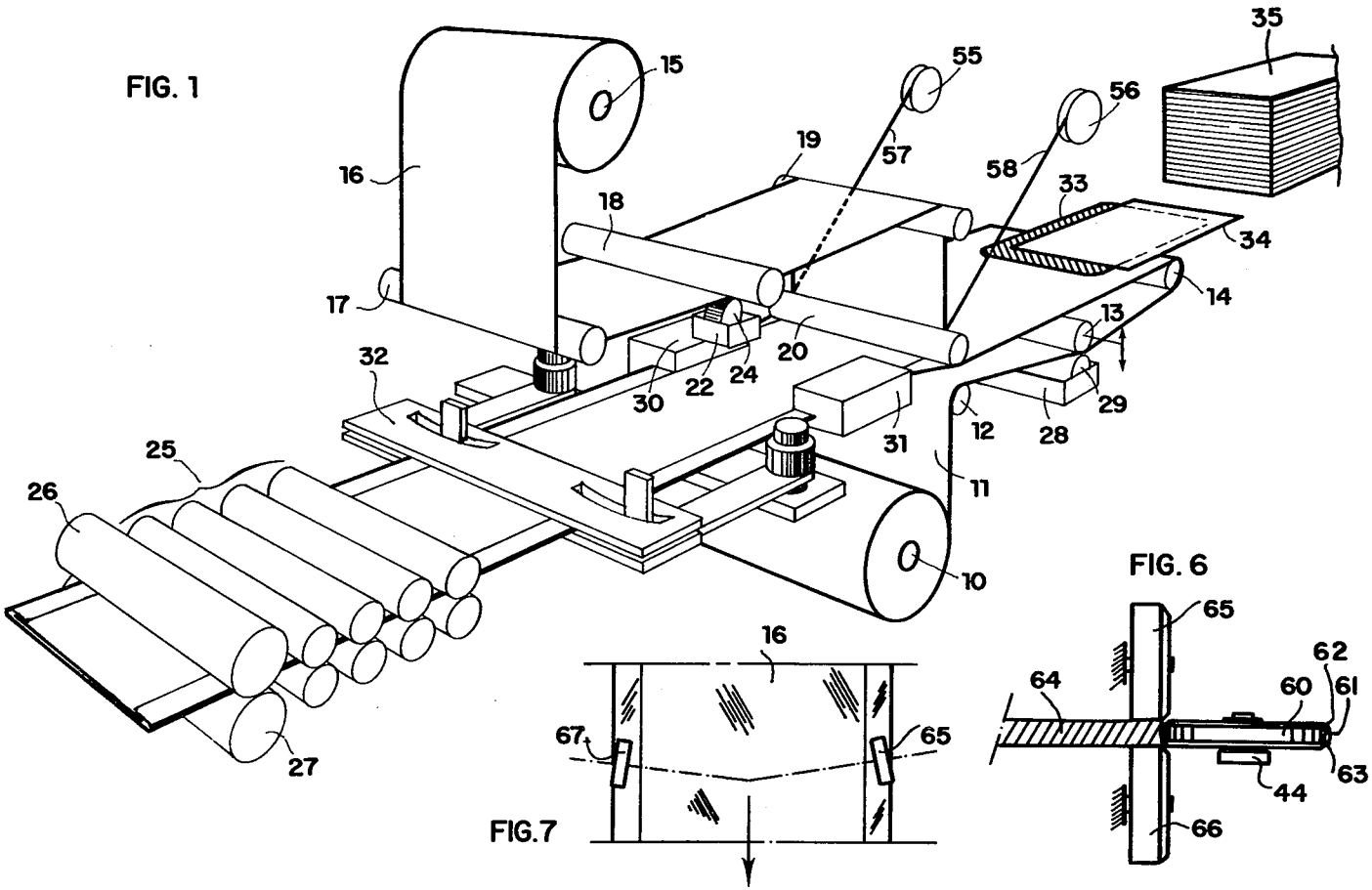

35
34
14
56
13
29
33
28
58
12
11
10
55
57
31
19
20
24
22
16
15
30
18
67
65
16
17
32
27
25
26

62
61
63
60
44
65
66
64

FOUR-CORNERED FLAT WRAPPING

This is a division of Ser. No. 174,807, filed Aug. 25, 1971, now U.S.P. 3,782,067 patented January 1, 1974.

The present invention relates to a method and apparatus for continuously wrapping flexible sheets and is particularly useful for wrapping radiographic film sheets.

In United Kingdom Patent Specification 1,141,805 corresponding to U.S.P. at No. 3,411,263 a method and apparatus are disclosed wherein sheets to be wrapped are fed successively onto spaced portions of a first travelling web of wrapper material having a width in excess of the corresponding dimension of the sheets, a second web is conducted above the path of the sheets so as to accompany them during their travel with the said first web, a tear strip is laid continuously between both webs, opposed marginal portions of the first web are folded over the second web and adhered thereto, and the first and second web are transversely secured together between the successive sheets and are also severed transversely to separate the successive wrapped sheets.

The described method of wrapping permits to produce an "edge to edge" wrapping, that is a wrapping which has two opposed edges lying close to the corresponding edges of the enclosed sheet of radiographic film. In the case each wrapping contains only one radiographic film sheet and the film is exposed through the wrapping, the advantage is obtained that at least one edge of the film sheet may be located close to an edge of an object to be radiographed, and that several film sheets may be positioned close to each other to produce a radiographic image which is practically uninterrupted.

If the sheets wrapped in accordance with the described method have been flexed before the two wrapping webs are secured to each other, the sheets may be firmly tensioned within the wrapping if the sheets are allowed to recover into substantial flat condition. The described measure is interesting for wrapping stacks of sheets, such as radiographic film sheets, since it may ensure the mutual immobility of the wrapped sheets.

If, however, one sheet only must be wrapped, then the tight wrapping is not only unnecessary but will mostly also be unfeasible, because the stiffness of one film sheet will not suffice to allow the wrapping to recover into flat condition.

It has now been noted that if one film sheet, or some sheets as the case may be, are not tightly wrapped, difficulties arise because the margins of the first web of wrapping material which have been folded over 180° tend to unfold into their previous position due to the inherent elasticity of the wrapping material. The two sheets of wrapping material thus tend to separate from each other with air being drawn into the package. This air causes the following difficulties.

If during the wrapping of the sheets, after the longitudinal margins of the wrapping webs have been secured to each other but before the transverse seals have been made, air is already drawn into the wrapping, this air must be removed before the transverse seals are made since otherwise "belly wrappings" are produced which first must be flattened before they can be conveniently packed in a box capable of containing some tens of wrapped sheets.

Furthermore, as a box containing a plurality of wrapped sheets is opened, the upper wrappings tend to buckle because of insufficiently biased by the weight of other wrappings, and some skill and time are required from the operator in order to flatten the wrappings before the box can be closed again.

A more serious problem arises when a wrapped radiographic film sheet is being exposed. As a matter of fact, the operator must carefully force out the air from the wrapping in order to ensure a sufficiently tight and uniform contact of the radiographic film sheet with the object which is being radiographed.

The present invention aims to provide a method and apparatus which permit to avoid the buckling of wrappings produced according to the method described hereinbefore.

According to the present invention, the basic method of wrapping flexible sheets, wherein the sheets are fed successively onto spaced portions of a first travelling web, a second web is conducted over the path of said sheets so as to accompany them during their travel with the said first web, opposed marginal portions of the first web are folded towards each other progressively along the length of such web over the successive sheets to obtain a wrapping of a predetermined width, said folded margins of the first web and opposed margins of said second web are secured together progressively along the length of the webs, and the first and second web are transversely secured together between the successive sheets and are also severed transversely to separate the successive wrapped sheets, is improved thereby in that, after the margins of both webs have been secured together, a substantially constant local pressure is applied progressively along the length of the webs on the outside of the curved portions of the folded marginal portions of the first web, while the adjacent flat portions of the web margins are kept parallel to one another, so that the elasticity of the web material at the folds is overcome.

Although the present invention is primarily concerned with the wrapping of separate radiographic film sheets, it should be understood that the method and apparatus according to the invention are also suited for the wrapping of small stacks of film and other sheets. These sheets may be different as to thickness and flexibility, and an example of the wrapping of such different sheets is given in the description of an embodiment of the invention.

The apparatus for wrapping sheets according to the present invention comprises means for continuously advancing a first web, means for continuously advancing a second web over said first web so that sheets which are placed in succession on said first web are engaged between the two webs, folding members for folding opposed marginal portions of said first web over said second web, means for adhering the folded margins of the second web to the margins of the first web, means which determine a narrow passage for at least the marginal portions of the wrapping formed by the two adhered webs and the enclosed sheets, the height of said passage just exceeding the thickness of the wrapping, and pressure members which are located at the lateral sides of the path followed by the wrapping and which are arranged for exerting a substantially constant pressure over a short length on the flexed portions of the folded margins of the first web as the wrapping is being conveyed through said narrow passage and withheld thereby from buckling as the lateral pressure is exerted.

Preferred embodiments of the apparatus of the invention are as follows.

The pressure means are formed by two arms which are rotatable in the plane of the webs, and the free ends thereof are provided with upstanding pressure members.

The arms are interconnected by a tension spring which is attached to the arms at a point close to the axis of rotation of the arms. This spring mounting shows the advantage that the spring undergoes but very small variations in length as the arms move, so that an almost uniform tensioning is obtained.

The pressure members are in the form of small rollers so that a rolling friction with the folds of the wrapping material is obtained.

The means determining the narrow passage are formed by two closely spaced plates which are provided at either lateral side with a slot through which the said pressure members protrude.

Figures 2, 3, 4, 5:
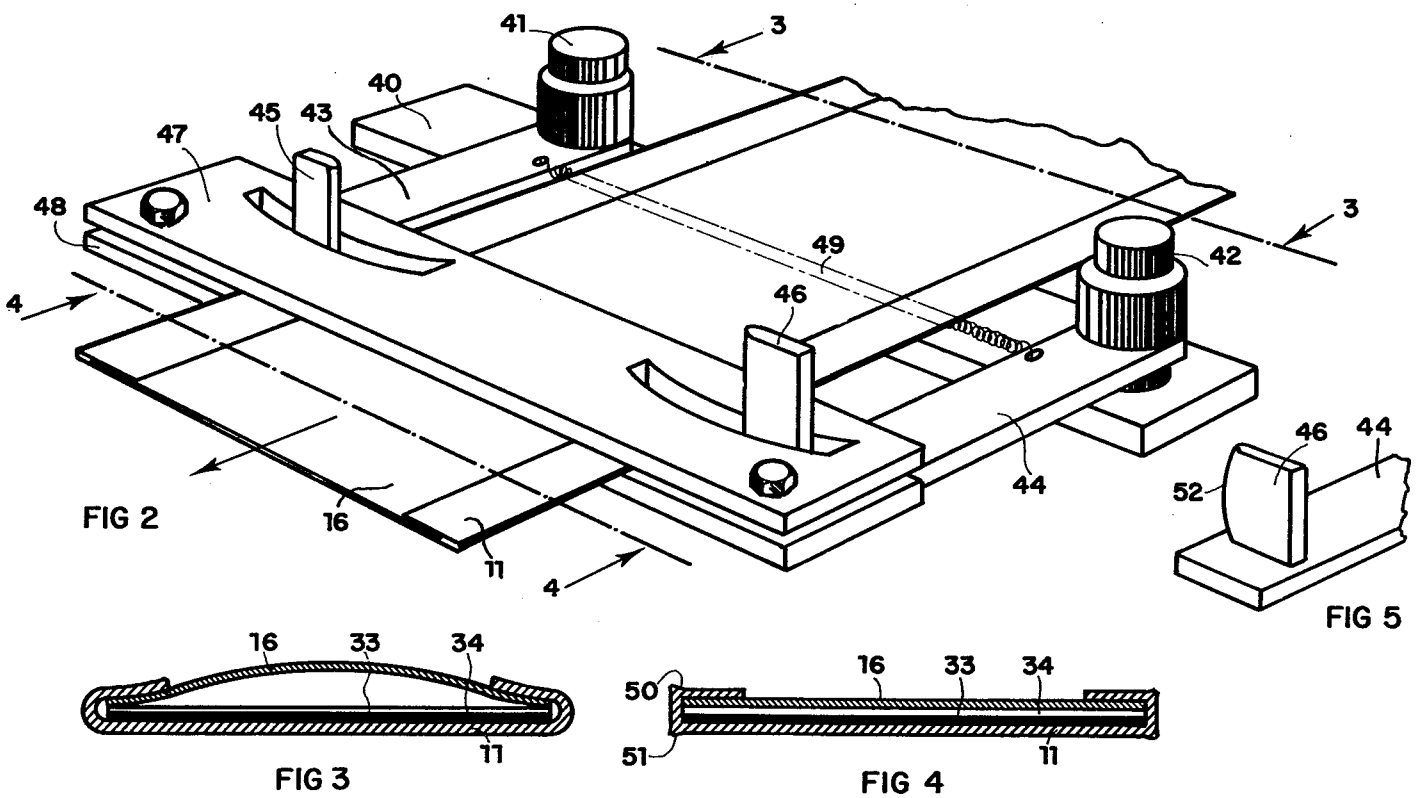

The invention will be described hereinafter, with reference to the accompanying drawings, in which:

FIG. 1 is a diagrammatic perspective view of an apparatus according to the invention, FIG. 2 is a detailed view of the pressure means for reducing the elasticity of the folds, FIG. 3 is a transverse cross section of a film wrapping on line 3—3 of FIG. 2, FIG. 4 is a transverse section of a film wrapping on line 4—4 of FIG. 2, FIG. 5 is a view of a modified pressure member, FIG. 6 is a view of a rotatable pressure member and FIG. 7 is a view of a particular position of rollers which stretch the wrapping.

The apparatus illustrated in FIG. 1 comprises the following rotatable members for the webs. A core 10 which supports a roll of a first web 11 of wrapping material, freely rotatable rollers 12, 13 and 14 over which said web is drawn, a core 15 which supports a roll of a second web 16 of wrapping material, freely rotatable rollers 17, 18, 19 and 20 over which said second web is drawn, pairs of pull rollers 25 which pull the webs through the apparatus and which apply extra pressure to the adhered margins and co-operating cutting rollers 26 and 27.

The apparatus comprises further a tray at each lateral side of the web, such as the tray 22 shows at the right side of the web according to FIG. 1, which trays contain a liquid adhesive which may be applied through a narrow applicator roller such as the roller 24, on the margins at the underside of the web 16, a tray 28 which contains liquid adhesive which may be applied through applicator roller 29 at the web 11 and over the full width thereof, the folding members 30 and 31 which fold the lateral margins of the first web over the margins of the second web and a device 32 for removing the tension from the folds of the first web. Further, the apparatus comprises a feed mechanism 35 which is arranged for depositing a sheet of radiographic film 33 together with a cardboard sheet 34 onto the moving web 11. The feed mechanism is synchronized with the roller 13 which is vertically displaceable so that the web is briefly put in contact with the adhesive applicator roller 29 to apply to the web a transverse strip of adhesive which is situated between successive sheets applied to the web. In a similar way. the rotatable cutters 26 and 27 are synchronized to sever in time relation the wrappings on a line which is situated in the middle of the areas where the webs have been transversely adhered to each other.

Finally, the apparatus comprises rolls 55 and 56 from which tear strips 57 and 58 are drawn and fed between the webs to lie at the inner side of the formed folds.

The device 32 for removing the tension from the folds of the first web is shown more in detail in FIG. 2. It comprises a fixed support 40 which extends transversely under the web path and which is provided at its ends with upstanding pins 41 and 42 around which arms 43 and 44 may pivot in a plane parallel to that of the webs. The free ends of the arms are provided with upstanding pressure members 45 and 46, the facing sides of which are rounded off through 180 angular degrees. The pressure members extend through curved slots in two plates 47 and 48 which extend transversely of the web path and which are fixedly spaced in parallelism over a distance which slightly exceeds the thickness of a wrapping. The arms 43 and 44 are interconnected by a helicoidal tension spring 49 to urge their free extremities towards each other. The attachment of the tension spring to a point of the arms which is close to their pivot axes has the advantage that the pressure exerted by the pressure elements 45 and 46 is substantially constant, even if the width of a wrapping slightly varies.

The operation of the apparatus will now be described for one particular type of film wrapping.

The core 10 contains a roll of wrapping material with a width of 230 mm. The material is formed by a black pigmented polyethylene layer to which at one side an orange coloured paper layer and at the other side a black pigmented paper layer have been laminated. The total thickness of the laminate amounts to 0.1 mm. The core 15 contains a roll of wrapping material 16 which is of identical composition as the web 11, but which has a width of 200 mm. The film sheets to be wrapped are radiographic films provided with a light-sensitive emulsion at both sides, and which measure 200 by 253 mm.

The web 11 carrying the film and cardboard sheets is passed under the roller 20 where web 16 is made to meet the web 11.

Immediately after the roller 20, the margins of the web 11 are engaged by the folding members 30 and 31, and they are turned smoothly and progressively through 180° over a width of about 12 mm until they are applied on top of the corresponding margins of the web 16. Said margins of the web 16 have been provided with an uninterrupted adhesive layer by the applicator rollers 23 and 24 so that a longitudinal bond is formed between the two webs. In addition, the webs are also transversely secured to each other over a width of about 2 cm between the successive film sheets by transverse strips of adhesive intermittently applied by the roller 29.

As shown in FIG. 3, the wrapping leaving the folding members has a transverse cross-section between two successive transverse bonds.

During the further travel, the wrapping passes between the pressure members 45 and 46 which apply a firm pressure in lateral direction to the edges of the wrapping. The sides of the members facing each other were rounded off to a radius of 1.5 mm. The folded margins of web 11 strongly tend to recover into substantial flat condition but they are prevented from doing so by the plates 47 and 48. The pressure applied by the members 45 and 46 and the counter pressure exerted by the plates 47 and 48 causes the folds to sharply bend through 90 degrees at the upper and the lower corners 50 and 51 as shown in FIG. 4, so that the wrapping material 11 is overtensioned at this loci and its elasticity is sufficiently reduced to prevent any further buckling of the wrapping.

The webs further pass through the pairs of rollers 25 which apply extra pressure to the adhering margins and which also determine the speed of the webs through the apparatus. Finally, the webs pass between the cutting rollers 26 and 27 which sever the successive wrappings, and which apply extra pressure on the transverse wrapping margins.

The film wrappings produced in accordance with the described method could be stored for several days, without the form of the wrapping deviating from that shown in FIG. 4.

It should be understood that the invention is not limited to the described apparatus. Thus, the pressure members may have other forms than the one shown, and one of them is illustrated in FIG. 5 wherein the side 52 of the member which engages the fold is curved also according to the height of said member so that the lateral side of the wrapping may be curved concavely whereby a still more efficient removal of the stress from the wrapping material may be obtained.

According to another embodiment, the movable pressure members 45 and 46 may be mounted close to or into the folding members 30 and 31. It should be understood, however, that the pressure members have a function which is different from that of the folding members and hence this differing function cannot be performed by the folding members themselves e.g. by the appropriately rectangularly shaped ends thereof. As a matter of fact, the folding members are mounted in fixed relation to each other in order to produce wrappings the width of which remains constant. If the folding members were mounted in a displaceable way and spring-biased towards each other, the width of the wrapping would vary continuously as a consequence of insufficient stiffness of the film- and cardboard sheet, the rigidity of the wrapping web etc. Therefore, it is important that first the folds be made at a substantially constant width of the wrapping, that the margins of the first sheet be secured to the margins of the second sheet, and that thereupon a pressure be applied to remove the elasticity of the material at the folds.

A still further embodiment of the pressure members is shown in FIG. 6. It may be seen that the rigid pressure members 46 have been replaced by a rotatable pressure member such as the small roller 60 which is rotatably fitted to the extremity of the pivotable lever 44. The roller has a cylindrical peripheral portion 61 with two beveiled edge portions 62 and 63. The width of the cylindrical portion 61 is smaller than the thickness of the wrapping 64, shown schematically in cross-section, so that the central portion of the fold of the wrapping receives a greater pressure than the edges thereof. Thereby a somewhat hollow or concave form of the fold is obtained whereby the elasticity of the wrapping material may more efficiently be overcome, similarly to the effect of the embodiment illustrated in FIG. 5.

An arrangement with a rotatable pressure member as described may be desirable in case the wrapping material has rather abrasive properties. Experience has shown that such kind of wrapping material is not at all an exceptional one, and that it may considerably reduce the lifetime of a stationary pressure member, even if the latter is made of hardened steel.

The rotatable pressure roller 60 may be located between the two plates 47 and 48 shown in FIGS. 1 and 2, but it is also possible to omit these plates and to provide near the edges of the wrapping a pair of rollers such as the rollers 65 and 66 shown in FIG. 6 which are freely rotatable around fixed axis located in a horizontal plane, and which have a bevelled edge at their outer side. In the mentioned way, the sliding contact of the wrapping with the plates 47 and 48 is replaced by a rolling contact with the rollers 65 and 66.

According to a further embodiment, the axis of the pair of rollers 65 and 66 do not coincide with the axis of the corresponding pair of rollers at the opposite edge of the wrapping but, on the contrary, the axis of the rollers at the upper and at the lower side of the wrapping intersect each other at an angle as shown in FIG. 7 for the upper rollers 65 and 67. In the mentioned way, the two pairs of rollers tend to make the margins of the wrapping follow mutually diverging paths as the wrapping advances in the direction as indicated by the arrow. Thereby a stretching effect is obtained for the wrapping, whereby the buckling of the wrapping may be overcome or considerably reduced.

The number of sheets wrapped in each wrapping may be greater or smaller. For instance, in case intensifying screens are required for the exposure of a radiographic film sheet, one or two lead foils or the like may be wrapped, together with the film and cardboard sheet. Alternatively, if a more simple wrapping is required, the separate cardboard sheet 34 may be omitted and the roll of wrapping material 16 replaced by a roll of appropriate cardboard so that the cardboard directly forms the top layer of the wrapping.

Finally, the securing of the webs of wrapping material to each other may also be done in another way, e.g. by heatsealing, by using pressure-sensitive adhesives, etc.

We claim:

1. A film sheet wrapping for flat contents which includes at least one radiographic film sheet, said wrapping comprising a first sheet of wrapping material at one side of said contents, and a second sheet of wrapping material at the other side of said contents, one of said wrapping sheets being larger than the other along two opposite sides and having the margins on such sides folded inwardly over the contents into parallel contacting relation to the contiguous margins of the other wrapping sheet and adhered thereto, said larger sheet being creased along each of the two opposite exterior folded edges thereof to impart to such edge an inwardly curved concave configuration between an upper and a lower corner.

2. A film sheet wrapping according to claim 1 wherein the folded-over margins of said larger sheet are disposed exteriorly of the contiguous margins of the other wrapping sheet.

* * * * *